US011028603B2

(12) United States Patent
Yehia Abdel Aziz El-Sayed et al.

(10) Patent No.: US 11,028,603 B2
(45) Date of Patent: Jun. 8, 2021

(54) FUNICULAR ARCHED STEEL TRUSS FALSEWORK

(71) Applicant: The American University in Cairo, New York, NY (US)

(72) Inventors: Ahmed Yehia Abdel Aziz El-Sayed, Cairo (EG); Mohamed Darwish, Giza (EG); Khaled Nassar, Mohandesseen (EG)

(73) Assignee: The American University in Cairo, New York, NY (US)

( * ) Notice: Subject to any disclaimer, the term of this patent is extended or adjusted under 35 U.S.C. 154(b) by 0 days.

(21) Appl. No.: 16/620,520

(22) PCT Filed: May 30, 2018

(86) PCT No.: PCT/US2018/035173
§ 371 (c)(1),
(2) Date: Dec. 8, 2019

(87) PCT Pub. No.: WO2018/226483
PCT Pub. Date: Dec. 13, 2018

(65) Prior Publication Data

US 2020/0181928 A1 Jun. 11, 2020

Related U.S. Application Data

(60) Provisional application No. 62/516,821, filed on Jun. 8, 2017.

(51) Int. Cl.

| | |
|---|---|
| ***E04G 11/48*** | (2006.01) |
| ***E04G 1/34*** | (2006.01) |
| *E04C 3/04* | (2006.01) |
| *E04G 11/36* | (2006.01) |
| *E04G 1/24* | (2006.01) |
| *E04G 25/00* | (2006.01) |

(52) U.S. Cl.
CPC ..... *E04G 11/48* (2013.01); *E04G 1/34* (2013.01); *E04C 2003/0491* (2013.01); *E04G 11/365* (2013.01); *E04G 2001/242* (2013.01); *E04G 2025/006* (2013.01)

(58) Field of Classification Search
CPC ..... E04G 11/48; E04G 1/34; E04G 11/365; E04G 2001/242; E04G 2025/006; E04G 11/36; E04C 2003/0491; E01D 4/00; E01D 6/00; E01D 6/02
See application file for complete search history.

(56) References Cited

U.S. PATENT DOCUMENTS 9,093 A * 7/1852 Gridley ..... E01D 6/00 14/4
1,163,641 A * 12/1915 Cummings ..... E01D 22/00 14/2

(Continued)

OTHER PUBLICATIONS

Darwish 2016. Design of Funicular Arched Wooden False Work. https://www.researchgate.net/publication/311205594_Design_of_Funicular_Arched_Wooden_False_Work.

*Primary Examiner* — Patrick J Maestri
(74) *Attorney, Agent, or Firm* — Lumen Patent Firm

(57) ABSTRACT

A scaffold having an opposing pair of half funicular trusses that are detachably or pivotably connected in the middle to establish a funicular arched truss is provided, where when in a detached or pivoted state, storage and transporting a plurality of the half funicular trusses is simplified.

6 Claims, 3 Drawing Sheets

(56) References Cited

U.S. PATENT DOCUMENTS

| | | | | | |
|---|---|---|---|---|---|
| 1,398,079 | A | * | 11/1921 | Marks | E04B 7/02 52/338 |
| 1,611,376 | A | * | 12/1926 | Reiman | E04G 1/34 182/155 |
| 2,875,711 | A | | 3/1959 | Mackintosh | |
| 2,917,129 | A | | 12/1959 | Grover | |
| 3,336,717 | A | | 8/1967 | Ward, Jr. | |
| 4,890,993 | A | * | 1/1990 | Wilson | E04G 11/34 249/11 |
| 4,947,962 | A | * | 8/1990 | Helsper | B25H 1/06 182/108 |
| 5,195,291 | A | * | 3/1993 | Pomento | E04B 1/3211 52/644 |
| 7,028,442 | B2 | | 4/2006 | Merrifield | |
| 10,190,271 | B2 | * | 1/2019 | Thrall | E04C 3/40 |

* cited by examiner 102
110
110a
110b
146
110c
138b
128b
116c
144
outside
inside
112
142
142a
132b
142b
118c
114c
136
136a
136b
130b
122b
138a
120b
140a
118b
128a
114b
138
132a
116b
134a
126a
130a
122a
120a
118a
104
148
150
144
146
148
146
140
114a
132
122
134
116a
126
130
122
120
118
148
148

122
128
126
130
124
120

114
116
106
108

FUNICULAR ARCHED STEEL TRUSS FALSEWORK

CROSS-REFERENCE TO RELATED APPLICATIONS

This application is a 371 of PCT application PCT/US2018/035173 filed May 30, 2018. PCT application PCT/US2018/035173 claims the benefit of U.S. Provisional application 62/516,821 filed Jun. 8, 2017.

FIELD OF THE INVENTION

The present invention relates generally to construction steel truss formwork. More particularly, the invention relates to a steel truss false-work system derived from the funicular arch concept, hence reducing the material used within the structure and eliminating the need for stringers.

BACKGROUND OF THE INVENTION

Generally, it is common to find the terms formwork and false-work used interchangeably within the construction industry. However, they can be differentiated as follows: the formwork is considered to be the horizontal system that supports heavier concrete members while false-work is considered to be the temporary girders and shores and the lateral bracing that is supporting the system until concrete sets. Falseworks are either Job-built or prefabricated. The prefabricated systems are commercially used, with standard sizes and usually made of steel or aluminum. They are usually used more than once, and they require a higher life cycle. On the other hand, the job-built systems are built to suit only one job and often made of wood. They are used when the requirements of a job cannot be met by the commercially available systems. Their lifespans are often small since they are fabricated to suit a specified job.

The conventional (traditional) systems have main components that include: sheathing, joists, stringers and shores. Sheathing is the material in contact with the freshly poured concrete surface. The load supported by the sheathing is transferred to the joists. The joists are beams that transfer the load to the stringers. The stringers are the main beams that transfer the load to the shores. Shores are the vertical or inclined members that support the stringers, joists and the decking. The shores of the system are then braced using the cross-bracing members to withstand the lateral loads, these shores are made of wood within conventional systems while are typically made of steel within commercially used systems.

Heavy-duty systems were the logical development after the first generation of steel shoring. These frames were standardized to have an outer diameter of 60.3 mm or 63.5 mm (2 and ⅜ or 2.5 inch) with a wall thickness of 3.2 mm. This also was accompanied by the development in the shoring accessories. U-heads, screws legs and standard bracing sizes were introduced which made the heavy-duty system more adaptable and easy to use for the contractors. The bracing of the scaffold types available in the market has a variety of spans. It spans a distance between frames that ranges between 0.6 and 3 m. This distance can be expanded to range between 3.6 to 4.5 m when using the long-span horizontal shoring beams.

The tube-and-coupler system includes vertical posts and two horizontal members called Runners to connect the posts together. The system is braced by an inclined member to control sway in the system. All the members in this system are tubes connected together by couplers. Newer systems consist of welded-steel-frames that are put on top of each other in order to reach the desired height of the concrete structure. The frames are put beside each other and are connected with cross-bracing members that are connected to the legs of the frames to provide lateral support for the new system. The welded-steel-frame system is more stable than the older system since most of the members are welded together and the cross bracing is connected to the frames through a small piece of steel welded to the legs of the frames which provides more stability.

The weight of the systems can vary greatly according to the manufacturer of that system. However, an average weight of 160 kg per heavy duty tower of falsework has been reported. On the other hand, a standard normal frame tower will weigh 10 to 20% percent less than the heavy-duty system. Therefore, the standard normal frame tower will have a weight that ranges between 128 kg to 145 kg.

On the other hand, formwork is one of the largest cost components in building structural frames. The cost of the formwork system can exceed the material costs of reinforced concrete in some extreme situations. Hence, formwork design is very important to help in reducing the cost of constructing a floor by 25%. The efficiency of the formwork design can also reduce the cost by reducing the amount of time needed to erect the formwork in addition to the cost of the formwork material itself. This means less direct and indirect cost by decreasing the number of working hours of labor and by saving formwork material. The benefits of an efficient design of the formwork also includes: increased productivity for labor, reduced potential for errors and enhance the safety procedures and conditions.

Since formwork appears in the beginning and the end of the construction process, it is appropriate to say that it has direct impact on the construction cost. Consequently, choosing the wrong formwork system will have drastic effect on the construction. The formwork system should be chosen while considering some factors such as system's productivity, safety, durability and the site conditions. The components of the formwork system that directly affect its cost have been studied. The factors considered included sheathing, joists, stringer, wood shores and the different combinations available for slab formwork components. These data were fed to an optimization code that its results were compared against the cost of the traditional formwork system. Optimizing different formwork components led to saving 9.9% of the formwork cost. Other studies correlated the layout of the structure to the formwork system choice.

However, researches focusing on development of new falsework systems have been rarely published as most of these efforts are performed by companies working in the industry itself.

What is needed is a design and method of a falsework system that will decrease the axial forces on the members and decrease the mid-span deflection and consequently the cross section of each member in the steel truss to replace several frames of the currently used commercially used shores by only two steel trusses to improve construction ease, time, its effect on the space availability within the construction site and its positive impact on the environment in terms of saving a large amount of steel used in shoring activities.

SUMMARY OF THE INVENTION

To address the needs in the art, a device and method of making a support structure is provide that includes detachably or pivotably connecting in opposition, at least one pair of half funicular arched trusses, where each half funicular arched truss includes an exterior vertical member having a footing at a bottom end and a structure mount at a top end, a bottom chord member having a bottom end of the bottom chord member connected proximal to the exterior vertical member bottom end and a top end of the bottom chord member connected to a bottom port of a four-point intermediate connector, where the intermediate connector includes the bottom port connected to a bottom portion of a connector housing and an outer port, a center port, and an inner port connected to a top portion of the connector housing, a diagonal member having a diagonal member bottom end connected to the inner port and a diagonal member top end connected proximal to the exterior vertical member top end, an interior vertical member having an interior vertical bottom end connected to the center port and an interior vertical member top end connected to a second structure mount, a second bottom chord having a second bottom chord bottom end connected to the outer port and a second bottom chord top end connected to a bottom port of a second four-point intermediate connector, a second diagonal member having a second diagonal member bottom end connected to an outer port of the second four-point intermediate connector and a second diagonal member top end connect proximal to the interior vertical member top end, a second interior vertical member having a second interior vertical bottom end connected to a center port of the second four-point intermediate connector and a second interior vertical top end connected to a third the structure mount, a third bottom chord having a third bottom chord bottom end connected to an outer port of the second four-point intermediate connector and a third bottom chord top end connected to a bottom port of a third four-point intermediated connector, a third diagonal member having a third diagonal member bottom end connected to an inner port of a third four-point intermediate connector and a third diagonal member top end connected proximal to the second interior vertical top end, a third interior vertical member having a third interior vertical member bottom end connected to a center port of the third four-point intermediated connector and an interior vertical member top end connected to a fourth structure mount, a fourth bottom chord having a fourth bottom chord bottom end connected to an inner port of the third four-point intermediate connector and a fourth bottom chord top end connected to a truss joiner, and a horizontal member connected to the truss joiner and connected proximal to the third interior vertical member top end and connected proximal to the second interior vertical member top end and connected proximal to first interior top end and connected proximal to the exterior vertical top end, where one half funicular arched truss detachably or pivotably connects to another the half funicular arched truss by detachably or fixedly connecting each truss half funicular arched truss to a truss joiner in opposition to form a funicular arched truss scaffold, where when in a detached or pivoted state, storage and transporting a plurality of the half funicular arched trusses is simplified. Finally, a horizontal tie rod connects the lower end of the exterior vertical member of one half of the funicular arched truss to another half of the funicular arched truss.

According to one aspect of the invention, each vertical member, diagonal member, bottom chord, and horizontal member are a hollow tube.

In another aspect of the invention, the ports and the housing four-point intermediated connector are hollow tubes.

In a further aspect of the invention, the bottom chords, the diagonal members, the interior vertical members and the four-point intermediate connectors include a truss member set, where the truss member set are assembled in a number that is scalable according to an intended height and span in an application.

In yet another aspect of the invention, a plurality of the funicular arched truss scaffolds are connected in parallel.

According to one embodiment, the invention includes a scaffold having an opposing pair of half funicular arched trusses that are detachably or pivotably connected in the middle to establish a funicular arched truss. According to this embodiment of the current invention, the opposing pair of half funicular arched trusses include a hollow metal tubing funicular arched structure. In one aspect of the current embodiment, a plurality of the funicular arched trusses are connected in parallel.

DETAILED DESCRIPTION

Commercially available systems currently used in construction require high initial cost, take time to be erected and reduce the space in the construction site for the movement of material, equipment and labor as they prevent movement underneath them. The current invention provides a new false-work system derived from the funicular arch; funicular arched steel truss (FAST) system. In one embodiment, the invention decreases the cost of the false-work, where less material is required for the structure and therefore needs lower initial cost than systems currently known in the art. Further, the new system is environmentally friendly as it achieves a range between 45% and 50% savings in the amount of $CO_2$ emitted to air due to the use of less material. The savings in the material used in the FAST system ranges between 45% to 51% depending on the covered area and it also provides more space in the construction site for the materials, equipment and workers to move underneath the system. The system also decreases the time needed for erection by range between 67% and 80% depending on the area and consequently helps in saving time and cost.

Figure 1:
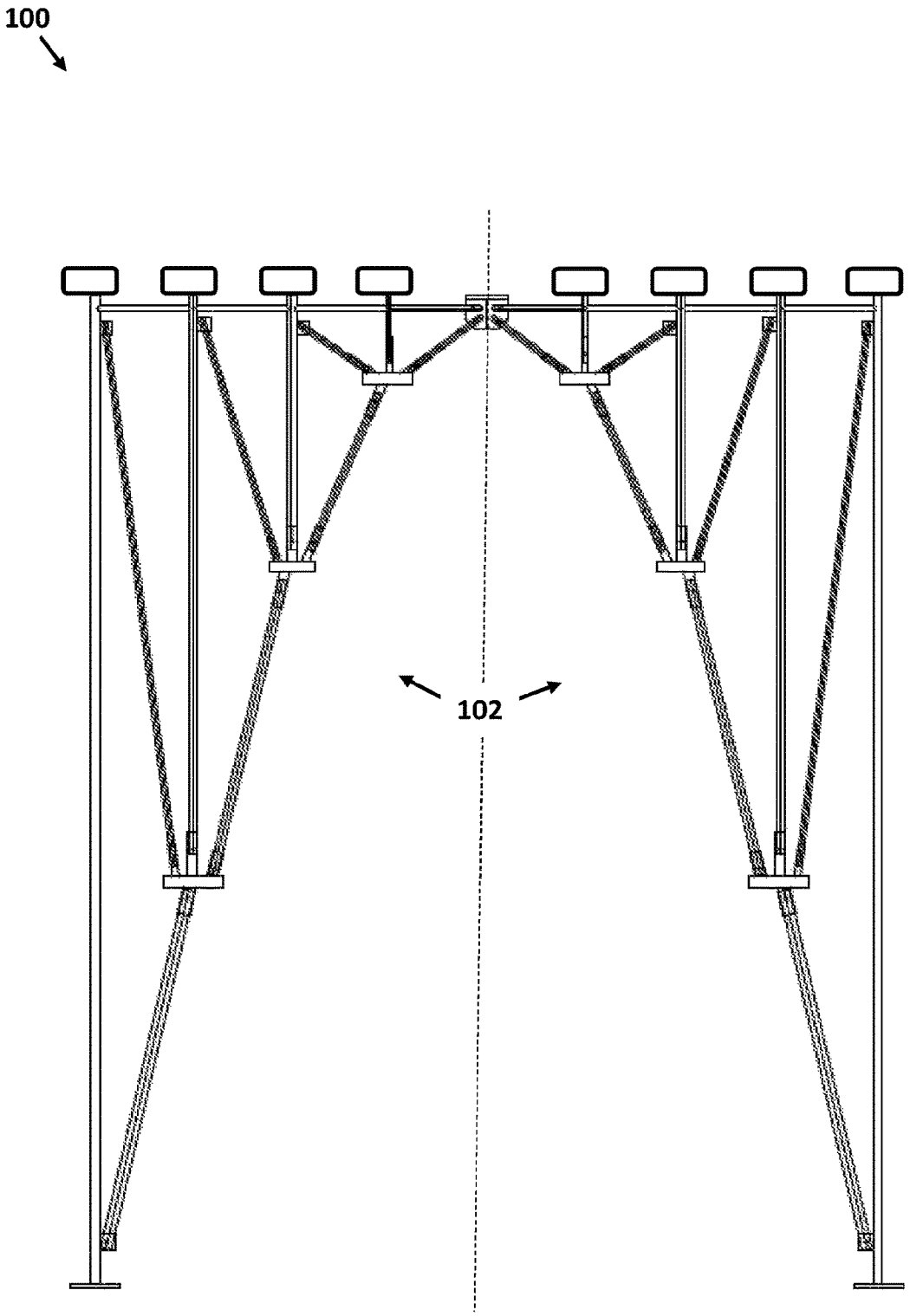
FIG. 1 shows a scaffold having an opposing pair of half funicular arched trusses that are detachably or pivotably connected in the middle to establish a funicular arched truss is provided, according to one embodiment of the invention.

A closed form solution is provided with members designed mainly to withstand buckling as they are all under compression. As shown in FIG. 1, one embodiment of the invention includes eight vertical members; the two outer vertical members are designed as steel tubes of 25.4 mm diameter, the four inner verticals are designed as steel tubes with a diameter of 25.4 mm, the most two inner vertical members are steel tubes of 16 mm diameter. The case is different for the bottom chords because the forces decrease as you go towards the inner bottom chords. The two outer bottom chords are designed as steel tubes of 31.75 mm diameter, the diameter decreases in the following two members to be 25.4 mm, and the diameter is decreasing in the following two members to be 19 mm and the two most inner bottom chord members are 16 mm diameter as they carry the least compression.

Furthermore, the current embodiment includes the upper horizontal chords, the diagonals and the bracing members having an outer diameter of 16 mm, which is the minimum limit for these zero members. In this example embodiment, all of these steel tubes have 1.25 mm thickness. Table 1 summarizes the diameters of all the members in half of the symmetric truss. Its numbering system is as follows: the connection between the upper chord members are given the odd number from (1, 3, 5, 7 and 9) and the connections of the bottom chord members are given the even numbers (2, 4, 6, and 8), however, they meet with the upper chord members in the intermediate hinged which has the number 9.

TABLE 1

Designed member dimensions per half truss.

| Member Name | Member Number | Length (mm) | Diameter (mm) |
|---|---|---|---|
| Exterior Vertical (EV) | EV (1-2) | 3000 | 25.4 mm |
| Stringer (Upper chord) | S | 272.5 | 16 mm |
| Interior Vertical (IV) | IV (3-4) | 1700 | 25.4 mm |
| | IV (5-6) | 700 | 25.4 mm |
| | IV (7-8) | 200 | 16 mm |
| Bottom Chord (BC) | BC (2-4) | 1225 | 31.75 mm |
| | BC (4-6) | 975 | 25.4 mm |
| | BC (6-8) | 575 | 19 mm |
| | BC (8-9) | 325 | 16 mm |
| Diagonals (D) | D (1-4) | 1650 | 16 mm |
| | D (3-6) | 750 | 16 mm |
| | D (5-8) | 275 | 16 mm |
| Scissors (SC) | SC (34-34) | 1220 | 16 mm |
| | SC (56-56) | 900 | 16 mm |

In order to add structural redundancy to the system, a tie rod with an outer diameter of 19 mm is added to the system in order to withstand the thrusting force that tries to open the arch once it is subjected to high loads instead of depending on the friction with the ground to take the horizontal reactions. Further, it allows the setup of the truss to be easily assembled on site since it holds the two halves together, fixes the span at the desired length since it reduces the risk of the arch to open; and reduces the sway of the truss.

Figures 2A, 2B, 2C:
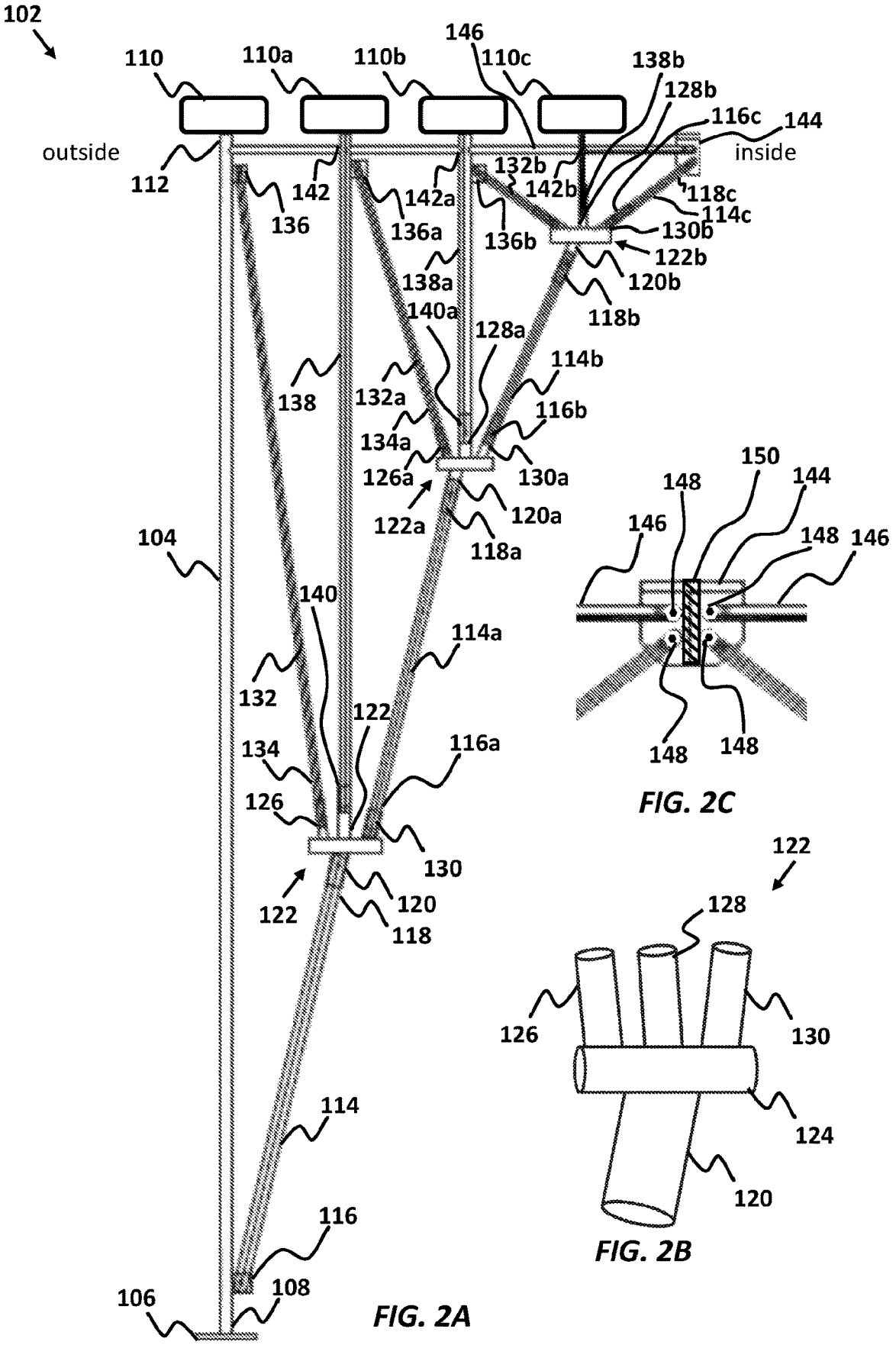
FIG. 2A shows a funicular arched truss half, according to one embodiment of the invention.
FIG. 2B shows an intermediate connector having a bottom port connected to a bottom portion of a connector housing, and an outer port, a center port, and an inner port connected to a top portion of the connector housing, according to one embodiment of the invention.
FIG. 2C shows a half funicular arched truss detachably connected using bolts, or fixedly connected by welding to another half funicular arched truss to a truss joiner that is a solid plate for the fixed connection, or a hinged plate for the fixed connection, according to embodiments of the current invention.

In FIG. 1, a funicular arched truss scaffold 100 is shown that includes at least one pair of half funicular arched trusses 102 detachably or pivotable connected in opposition, where each funicular arched truss half 102 is shown opposite a dashed line. FIG. 2A shows a funicular arched truss half 102 that includes an exterior vertical member 104 having a footing 106 at a bottom end 108 and a structure mount 110 at a top end 112. Further shown is a bottom chord member 114 having a bottom end 116 of the bottom chord member connected proximal to the exterior vertical member bottom end 108 and a top end 118 of the bottom chord member 114 connected to a bottom port 120 of a four-point intermediate connector 122.

As shown in FIG. 2B, the intermediate connector 122 includes the bottom port 120 connected to a bottom portion of a connector housing 124 and an outer port 126, a center port 128, and an inner port 130 connected to a top portion of the connector housing 124. The angles of the respective ports of the intermediate connector 122 are set according to their position in the structure.

Turning again to FIG. 2A, a diagonal member 132 includes a diagonal member bottom end 134 connected to outside port 126 and a diagonal member top end 136 connected proximal to the exterior vertical member top end 112. Further shown is an interior vertical member 138 having an interior vertical bottom end 140 connected to the center port 128 and an interior vertical member top end 142 connected to a second structure mount 110. A second bottom chord 114*a* is shown having a second bottom chord bottom end 116*a* connected to the inside port 130 and a second bottom chord top end 118*a* connected to a bottom port 120*a* of a second the four-point intermediate connector 122. A second diagonal member 132*a* is shown having a second diagonal member bottom end 134*a* connected to an outer port 126*a* of the second four-point intermediate connector 122*a* and a second diagonal member top end 136*a* connect proximal to the interior vertical member top end 142. FIG. 2A further shows a second the interior vertical member 132*a* having a second interior vertical bottom end 140*a* connected to a center top port 122*a* of the second four-point intermediate connector 122*a* and a second interior vertical top end 142*a* connected to a third the structure mount 110*b*. A third bottom chord 114*b* is shown having a third bottom chord bottom end 116*b* connected to an inner top port 130*a* of the second four-point intermediate connector 122*b* and a third bottom chord top end 118*b* connected to a bottom port 120*b* of a third the four-point intermediated connector 122*b*. Further shown is a third diagonal member 132*b* having a third diagonal member bottom end 134*b* connected to an outer port 126*b* of a third four-point intermediate connector 122*b* and a third diagonal member top end 136*b* connected proximal to the second interior vertical top end 142*a*. A third the interior vertical member 138*b* having a third interior vertical member bottom end 140*b* is shown connected to a center port 120*b* of the third four-point intermediated connector 122*b* and an interior vertical member top end 142*b* is connected to a fourth the structure mount 110*c*. Also shown is a fourth bottom chord 114*c* having a fourth bottom chord bottom end 116*c* connected to an outside port 126*c* of the third four-point intermediate connector 122*c* and a fourth bottom chord top end 118*c* connected to a truss joiner 144 (see FIG. 2C). A horizontal member 146 connected to the truss joiner 142 and connected proximal to the third interior vertical member top end 142*b* and connected proximal to the second interior vertical member top end 142*a* and connected proximal to first second interior top end 142 and connected proximal to the exterior vertical top end 112, where a half funicular arched truss 102 detachably connects using bolts 148 or pivotably connects by a hinge 150 (see FIG. 2C) to another half funicular arched truss 102 by detachably or pivotably connecting each to a truss joiner 144, that can be a solid or hinged element, in opposition to each other to form a funicular arched truss scaffold 100, where when in a detached state, storage (see FIG. 3) and transporting a plurality of the half funicular arched trusses is simplified. According to one embodiment, the truss joiner 144 is a hinge that enables the two half funicular arched trusses 102 to be folded together when in a storage or transportation state.

It is understood that the number of intermediate connectors 122 and that associated connecting members used in a funicular arched truss structure 100 can vary according to the height and span of the overall system.

Figure 3:
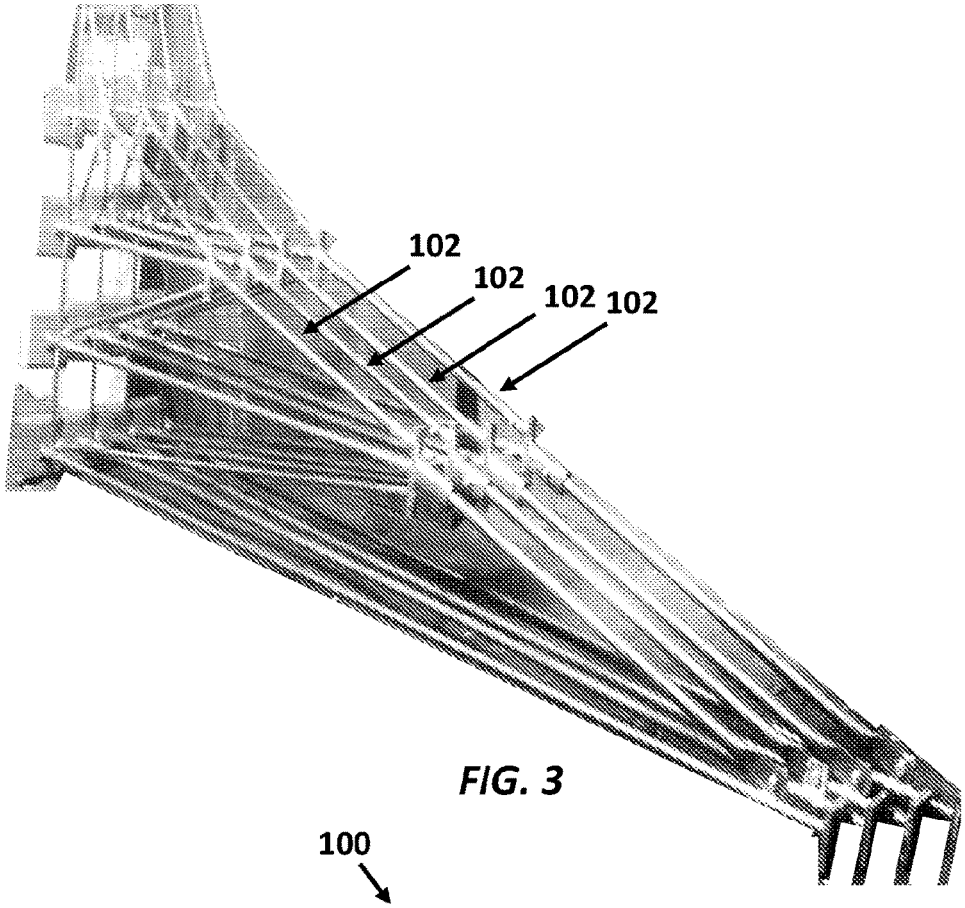
FIG. 3 shows multiple half funicular arched trusses arranged in a compact bundle for storage in relatively confined spaces, or simplified transportation, according to embodiments of the current invention.

FIG. 3 shows multiple half funicular arched trusses 102 arranged in a compact bundle for storage in relatively confined spaces, or simplified transportation.

Figure 4:
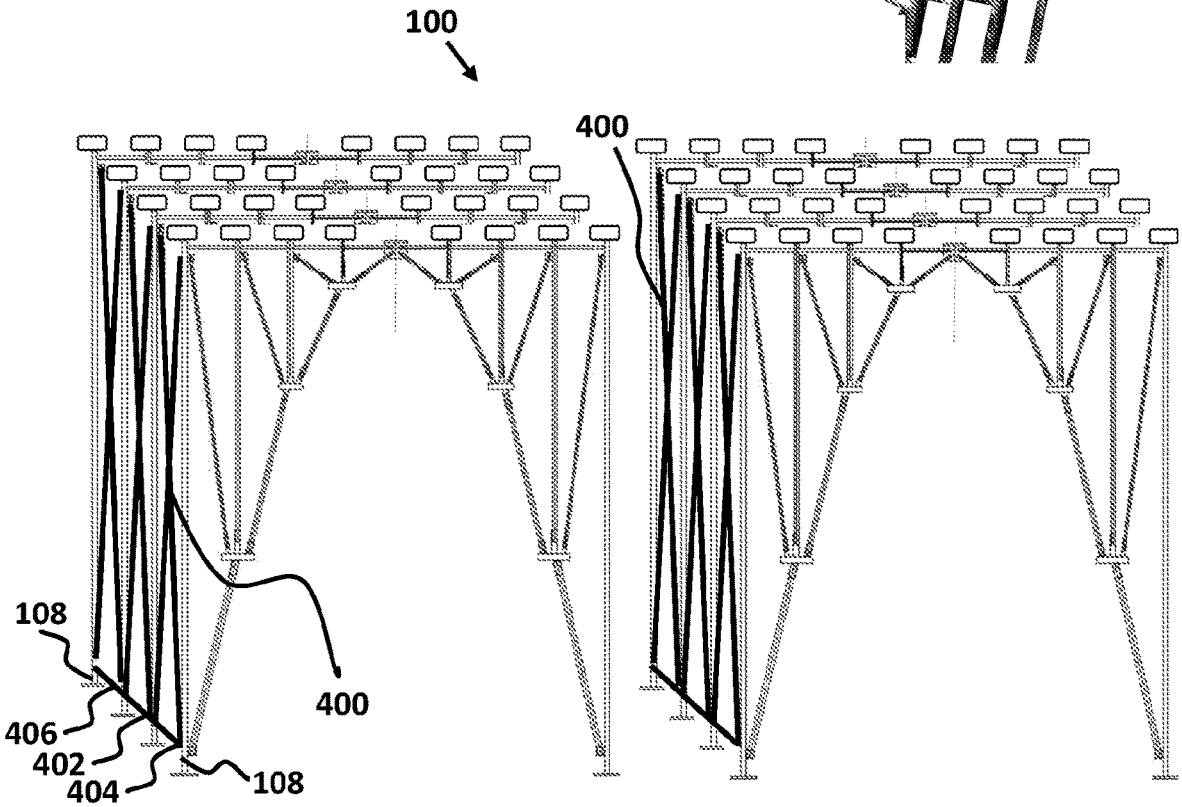
FIG. 4 shows multiple funicular arched truss scaffolds 100 in an assembled state, and arranged in series and parallel patterns, according to embodiments of the current invention.

FIG. 4 shows multiple funicular arched truss scaffolds 100 in an assembled state, and arranged in series and parallel patterns. The funicular arched truss scaffolds 100 are connected to other adjacent funicular arched truss scaffolds 100 using cross-bracing 400. Further shown is a horizontal tie rod 402 having a first end 404 connected proximal to the bottom end 108 of a first exterior vertical member 104 of a first half funicular arched truss 102 and a second end 406 connected proximal to bottom end 108 of at least one other exterior vertical member 104 of at least one other half funicular arched truss 102.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art.

The variations of the spans of the designed system have been studied in order to compare the savings in weight that it entails when compared to its commercially available counterparts. Table 2 shows the weights of the commercially available steel formwork systems and compares them to the weight of the designed system. It is clear that the weight of the commercially available system increases significantly in wide spans, however, the weight of the system is increases slightly for the spans from 2.4 meters up to 7.2 meters. This is because the lengths of the bottom chord members and the length of the diagonals increase with the increase in the span. Further, the increase in the diameter of the exterior vertical and bottom chord member (4-6) causes increase in the weight in spans of 6 and 7.2 meters. It was found that, originally, the FAST system has a 33% saving in the weight when the span is 2.4 meters. This means that, according to the previous assumption of the number of frames is used to compare the weight and the number of units in the two systems, that there is a saving of 4.89 kg/m2. This is calculated by dividing the weight of the eight units of the commercially available systems (63.65 kg) used to cover the area of 2.4×1.8 m (4.32 m2) to get the value of the weight of this system needed for each m2 from the floor area which yields a value of 14.73 kg/$m^2$. While the weight needed from the proposed system to cover the same area is calculated by dividing the weight of one unit of the system (42.5 kg) by the area (4.32 $m^2$) which yields a value of 9.84 kg/$m^2$. The difference between these numbers gives the savings in the weight of the systems per unit area.

TABLE 2

Effect of changing the arched truss span on the cost savings

| Span | Weight of Commercially available Steel System (kg) | Weight of Proposed System (kg) | Percentage of reduction in weight |
|---|---|---|---|
| 2.4 | 63.65 | 42.5 | 33% |
| 3.6 | 95.46 | 46.6 | 51% |
| 4.8 | 127.28 | 49.1 | 61% |

TABLE 2-continued

Effect of changing the arched truss span on the cost savings

| Span | Weight of Commercially available Steel System (kg) | Weight of Proposed System (kg) | Percentage of reduction in weight |
|---|---|---|---|
| 6 | 159.1 | 54.25 | 66% |
| 7.2 | 190.92 | 57.5 | 70% |

All such variations are considered to be within the scope and spirit of the present invention as defined by the following claims and their legal equivalents.

What is claimed:

1. A method of making a support structure, comprising detachably or pivotably connecting in opposition, at least one pair of half funicular arched trusses, wherein each said half funicular arched truss comprises:

a) an exterior vertical member comprising a footing at a bottom end and a structure mount at a top end;

b) a bottom chord member comprising a bottom end of said bottom chord member connected proximal to said exterior vertical member bottom end and a top end of said bottom chord member connected to a bottom port of a four-point intermediate connector, wherein said intermediate connector comprises said bottom port connected to a bottom portion of a connector housing and an outer port, a center port, and an inner port connected to a top portion of said connector housing;

c) a diagonal member comprising a diagonal member bottom end connected to said inner port and a diagonal member top end connected proximal to said exterior vertical member top end;

d) an interior vertical member comprising an interior vertical bottom end connected to said center port and an interior vertical member top end connected to a second said structure mount;

e) a second bottom chord comprising a second bottom chord bottom end connected to said outer port and a second bottom chord top end connected to a bottom port of a second said four-point intermediate connector;

f) a second diagonal member comprising a second diagonal member bottom end connected to an outer port of said second four-point intermediate connector and a second diagonal member top end connect proximal to said interior vertical member top end;

g) a second said interior vertical member comprising a second interior vertical bottom end connected to a center port of said second four-point intermediate connector and a second interior vertical top end connected to a third said structure mount;

h) a third bottom chord comprising a third bottom chord bottom end connected to an outer port of said second four-point intermediate connector and a third bottom chord top end connected to a bottom port of a third said four-point intermediated connector;

i) a third diagonal member comprising a third diagonal member bottom end connected to an inner port of a third four-point intermediate connector and a third diagonal member top end connected proximal to said second interior vertical top end;

j) a third said interior vertical member comprising a third interior vertical member bottom end connected to a center port of said third four-point intermediated connector and an interior vertical member top end connected to a fourth said structure mount;

k) a fourth said bottom chord comprising a fourth bottom chord bottom end connected to an inner port of said third four-point intermediate connector and a fourth bottom chord top end connected to a truss joiner; and l) a horizontal member connected to said truss joiner and connected proximal to said third interior vertical member top end and connected proximal to said second interior vertical member top end and connected proximal to first interior top end and connected proximal to said exterior vertical top end;

wherein one said half funicular arched truss detachably or pivotably connects to another said half funicular arched truss by detachably or fixedly connecting each said truss half funicular arched truss to a truss joiner in opposition to form a funicular truss scaffold, wherein said truss joiner is a solid plate or a hinged plate, wherein when in a detached or pivoted state storage and transporting a plurality of said half funicular arched trusses is simplified.

2. The method according to claim 1 further comprising a horizontal tie rod comprising a first end connected proximal to said bottom end of a first said exterior vertical member of a first said half funicular arched truss and a second end connected proximal to said bottom end of at least one other said exterior vertical member of at least one other said half funicular arched truss.

3. The method according to claim 1, wherein each said vertical member, diagonal member, bottom chord, and horizontal member comprise a hollow tube.

4. The method according to claim 1, wherein said ports and said housing four-point intermediated connector comprise hollow tubes.

5. The method according to claim 1, wherein said bottom chords, said diagonal members, said interior vertical members and said four-point intermediate connectors comprise a truss member set, where the truss member set are assembled in a number that is scalable according to an intended height and span in an application.

6. The method according to claim 1, wherein a plurality of said funicular truss scaffolds are connected in parallel.

* * * * *